US005491957A

United States Patent [19]

Maskell

[11] Patent Number: 5,491,957

[45] Date of Patent: Feb. 20, 1996

[54] METHOD AND DEVICE FOR EVACUATING GAS TIGHT ENVELOPE

[76] Inventor: Richard Maskell, 1175 Jansen Farm Ct., Elgin, Ill. 60123

[21] Appl. No.: 223,724

[22] Filed: Apr. 6, 1994

[51] Int. Cl.[6] ..... B65B 31/00

[52] U.S. Cl. ..... 53/434; 53/432

[58] Field of Search ..... 53/432, 433, 434, 53/510, 511, 512; 141/65; 606/148

[56] References Cited

U.S. PATENT DOCUMENTS

| | | | |
|---|---|---|---|
| 3,208,193 | 9/1965 | Rumsey, Jr. | 53/512 |
| 3,611,524 | 9/1969 | Broyles | 53/432 |
| 3,823,750 | 7/1974 | Owen | 141/65 |
| 4,221,101 | 9/1980 | Woods | 53/512 |
| 4,575,990 | 3/1986 | von Bismarck | 53/434 |
| 4,990,153 | 2/1991 | Richards | 606/148 |
| 5,044,142 | 9/1991 | Gianelli | 53/434 |

FOREIGN PATENT DOCUMENTS

| | | | |
|---|---|---|---|
| 1310029 | 9/1970 | United Kingdom | 53/434 |

*Primary Examiner*—John Sipos
*Assistant Examiner*—Ed Tolan
*Attorney, Agent, or Firm*—J. W. Gipple; Gipple & Hale

[57] ABSTRACT

An improved method and device are provided for evacuating gas from a gas tight envelope such as a bag of plastic film, enclosing solid or granular material. The vacuum probe used in accordance with the invention to evacuate the envelope has one or more parallel grooves or apertures extending its length. The probe is inserted into the envelope in such a way that the grooves or apertures tangentially oppose the contents of the envelope and provide a vacuum, across the length of the probe to prevent blocking of the probe and ceasing evacuation of the gas.

4 Claims, 3 Drawing Sheets

METHOD AND DEVICE FOR EVACUATING GAS TIGHT ENVELOPE

SUMMARY OF THE INVENTION

The present invention is directed to an improved method and device for evacuating gas from a gas tight envelope containing solid material. More specifically, the present invention is directed to an improved vacuum probe and method for evacuating gas from solid material enclosed by a flexible envelope such that the envelope more completely collapses around the solid material owing to a more fully distributed vacuum.

BACKGROUND OF THE INVENTION

In the food packaging industry, it is a common practice to assemble a cluster of food products (e.g. meat or poultry) which have been individually vacuum packaged in plastic film, and put the cluster into a larger plastic film bag or envelope, which is then gas flushed and vacuum evacuated, to produce a tight fitting, oxygen free, master package. This maintains the fresh quality of the food products during storage and transportation.

The present invention is applicable to this type of master package, as well as to one containing individual unclustered items.

To accomplish evacuation of the gas from the plastic film envelope, a vacuum probe is inserted into the film envelope and the gas is sucked out. One problem encountered with this process, is that the tip of the probe where the vacuum orifices are disposed is pressed against the content of the envelope and becomes clogged and ineffective. These orifices, which may be grooves extending only a short way from the probe tip, become clogged and ineffective by the collapsing plastic film envelope. This occurs because, in conventional practice, the vacuum probe provides a vacuum only at its tip.

Additionally, in the conventional approach the vacuum is applied through the probe inserted into the contents of the envelope, requiring that the envelope have its opening on the top surface of a generally broad and shallow package. This creates an envelope geometry which consumes a relatively large amount of plastic film for the product size.

One variation on the conventional approach is to evacuate a side or end loaded envelope by using a vacuum probe which enters in a horizontal plane. This side-inserted probe encounters the same problem as one inserted from above. As the plastic film envelope collapses around the probe, the grooves or slots at the tip of the probe tend to become blocked by the content of the envelope.

Accordingly, it is an object of the present invention to provide an improved method of evacuating gas from a gas tight envelope without clogging the vacuum probe which is evacuating the gas.

It is a further object of the present invention to provide a method for evacuating gas from a gas tight envelope containing solid material, in which a vacuum probe is utilized in such a manner that the vacuum is applied across substantially the entire face of the probe, tangentially opposing the solid material in the envelope.

Yet a further object of the present invention is to provide a methodology for evacuating gas from a gas tight envelope containing a solid material which avoids potential clogging of the vacuum probe by either by the collapsing envelope or the content thereof.

DETAILED DESCRIPTION OF THE INVENTION

In accordance with the present invention, a unique method is provided for evacuating gas from a gas tight envelope such as a plastic bag containing one or more objects that may be individual or clustered. According to the invention, the vacuum probe which is a generally flat elongated structure having a plurality of apertures or grooves longitudinally disposed on the surface of the probe is inserted through the mouth of the envelope into the interior such that the face of the probe having the apertures or grooves is essentially opposed to the contents of the envelope rather than having only the tip of the probe directly opposing the contents. A vacuum is then applied to the probe to withdraw the gas from the envelope through the probe along its entire surface thereby avoiding blocking of the probe by either the solid material or the collapsing envelope. In this manner a complete evacuation of the envelope is accomplished with the flexible envelope collapsing tightly around the material contained therein. In the conventional approach, the vacuum probe is effective only at the tip and if that is clogged by the envelope or the content of the envelope, evacuation of the gas ceases.

In another aspect of the invention, improved vacuum probes are provided in which slots or apertures extend essentially the entire length of the probe to facilitate distribution of the vacuum.

The invention in its various aspects will however be more fully appreciated by having reference to the drawings which illustrate preferred embodiments thereof.

Figure 2:
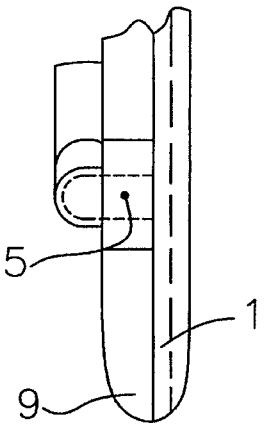
FIG. 2 illustrates the vacuum probe of FIG. 1 in its retracted position.
Figure 1:
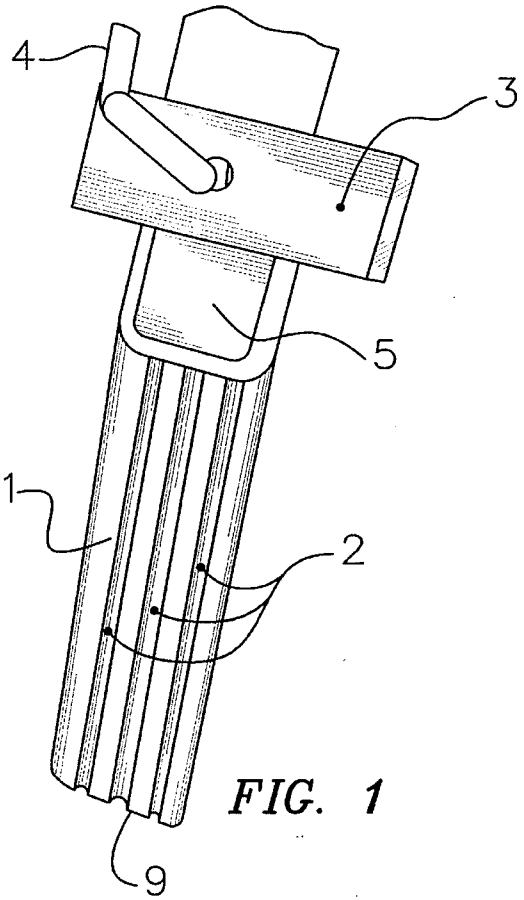
FIG. 1 is a perspective view of a vacuum probe and vacuum manifold plate typically employed in accordance with one aspect of the invention.

Directing attention to the drawings, FIGS. 1 and 2 illustrate the vacuum probe which can be employed in accordance with one aspect of the invention in both its extended and retracted positions. In FIG. 1 of the drawings, the vacuum probe 1, which is a generally flat elongated structure having a plurality of longitudinally disposed parallel grooves 2, is attached at one end to a manifold consisting of a vacuum cover plate 5 which communicates with a vacuum supply tube 4. The vacuum supply tube 4 is attached to a suitable source of negative pressure such as a vacuum pump which is not shown in the drawings. A manifold 3 in the vacuum cover plate distributes the vacuum to the grooves 2 of the vacuum probe 1. The face of the vacuum cover plate 5 is pressed or sealed against the vacuum probe by springs on each side of the cover plate which are not shown on the drawings.

Figure 3:
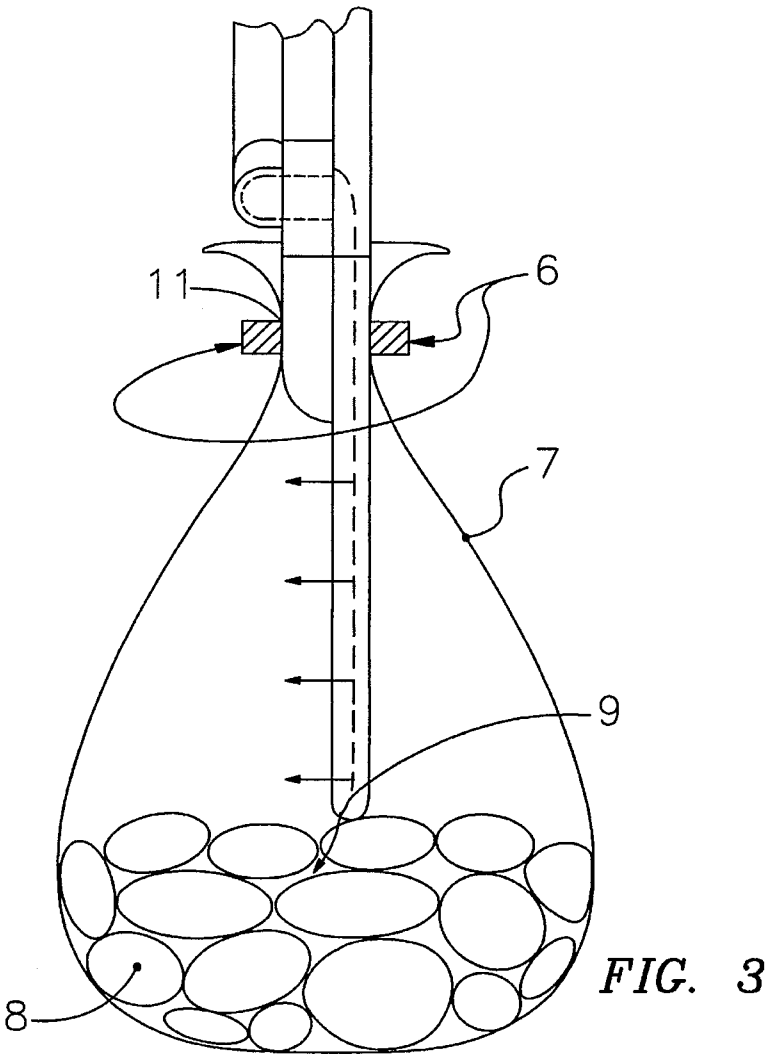
FIG. 3 illustrates a procedure of the prior art whereby the vacuum probe is inserted into the middle of a master package envelope containing clustered material.

In the retracted position illustrated in FIG. 2 of the drawings, the lower tip 9 of the probe is coincidental with the lower tip of the vacuum cover plate 5 to facilitate insertion into envelope 7, as illustrated in FIG. 3 of the drawings, during the envelope loading process.

Figure 4:
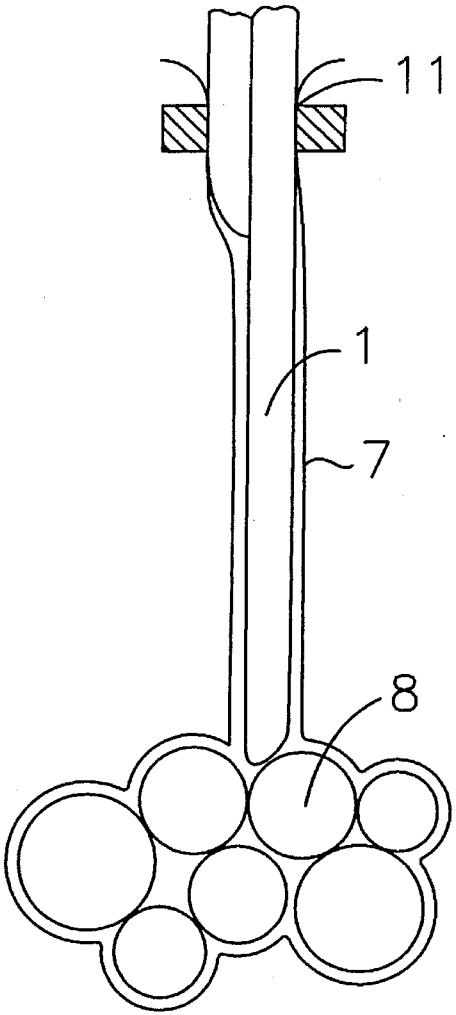
FIG. 4 illustrates the prior art procedure of FIG. 3 whereby the envelope has collapsed around the vacuum probe and the clustered material in the envelope.

Turning to FIGS. 3 and 4 of the drawings, once the envelope is pulled up around the probe and its cover plate, the jaws 6 are clamped over the assembly to provide an air tight seal. The jaw clamps the bag 7 shut across the width of the envelope mouth 11 and rubber seals close the envelope around the probe and cover plate. The retracted probe 1 is then extended into the envelope 7 and vacuum applied through the vacuum supply tube and manifold across the face of the probe into the envelope. When the envelope head space is still incompletely evacuated, vacuum is available to the interior of the envelope through the grooves across the entire front face of the probe. Once the envelope collapses tightly against the grooves, the grooves become in effect tubes with the plastic envelope acting as a fourth side of each tube as illustrated in FIG. 4 of the drawings.

In conventional practice, as shown in FIGS. 3 and 4 of the drawings, the product 8 typically is a solid or granular material which is positioned at the bottom of the envelope 7 below the tip 9 of the extended probe 1. After the envelope collapses on the probe as shown in FIG. 4 of the drawings, vacuum is conveyed to the product only at the tip of the probe 9 as also shown in FIG. 4 of the drawings. And if the tip is clogged by the content of the envelope, evacuation of the gas from the envelope ceases.

Figure 6:
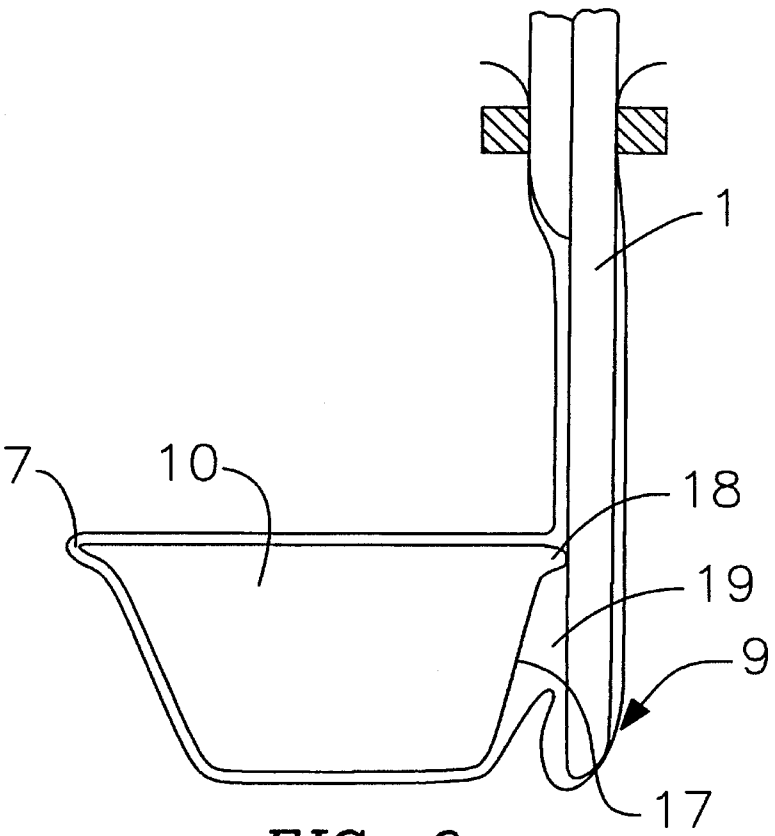
FIG. 6 illustrates the procedure of the present invention whereby the vacuum is applied across the entire surface of the probe tangentially to a single object in master package.
Figure 5:
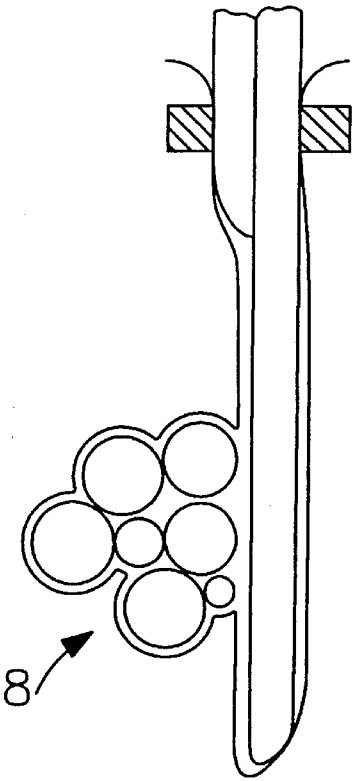
FIG. 5 illustrates the procedure of the present invention whereby the vacuum is applied across the entire surface of the probe tangentially opposing the product.

In contrast to the practice of the prior art, as illustrated in FIGS. 3 and 4 of the drawings, the method of the present invention as shown in FIGS. 5 and 6 of the drawings, uses a probe which passes vertically downward alongside and opposite the product 8 so that the vacuum applied to the vacuum probe is transmitted to the product 8 from the front face of the probe rather than from just the lower tip as shown in FIG. 4 of the drawings, even after the bag has collapsed around the probe as shown in FIG. 4 and 5 of the drawings.

This procedure in accordance with the present invention provides an improved process in which gas continues to be evacuated along the entire face of the probe opposite where the solid material content of the envelope is disposed even if the tip of the probe becomes blocked.

The present invention is particularly useful and significant where the content of the envelope creates a broad but shallow shape. The use of a vacuum probe in conventional manner requires an envelope which has its opening on the top surface of a broad shallow shaped package which creates an envelope geometry consuming a relatively large amount of bag film material for the product size. On the other hand, if a side loaded or end loaded envelope is used for a package having this shape, very substantial savings are available as the envelope may be as much as 30% smaller in over all size.

In accordance with prior art procedures, the conventional approach for a side or end loaded envelope (not illustrated in the drawings), has been to use a hollow or tubular probe entering the envelope in a horizontal plane. This procedure encounters the same problem as the probe entering on a vertical plane in that the vacuum is conveyed to the probe only at its tip which is vulnerable to being blocked by either the envelope's plastic film material or the content of the envelope. In accordance with the present invention the entire surface of the vacuum probe remains exposed to the content of the envelope so that blockage of the vacuum probe is avoided and the vacuum can continue to be exerted around the content to remove gas or air from voids that would otherwise remain.

Thus, in accordance with the present invention the vacuum probe is inserted tangentially either vertically or horizontally, into an envelope containing solid or granular material, with the face of the probe (having the parallel longitudinal grooves) remaining opposed to the content of the envelope such that it can continue to exert a vacuum against both the material and the collapsing envelope until it is essentially completely evacuated without becoming clogged by either the envelope or its content.

Figure 7:
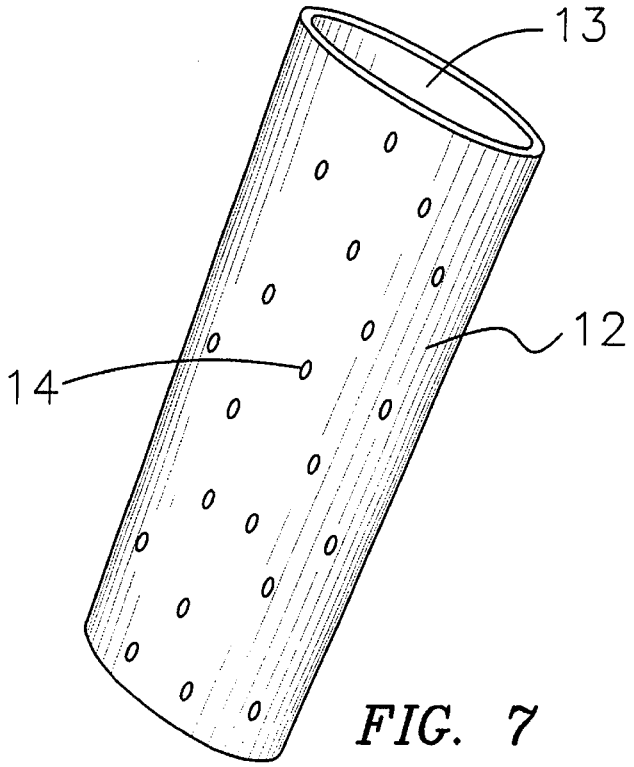
FIG. 7 illustrates an embodiment of the improved probe of the present invention.
Figure 8:
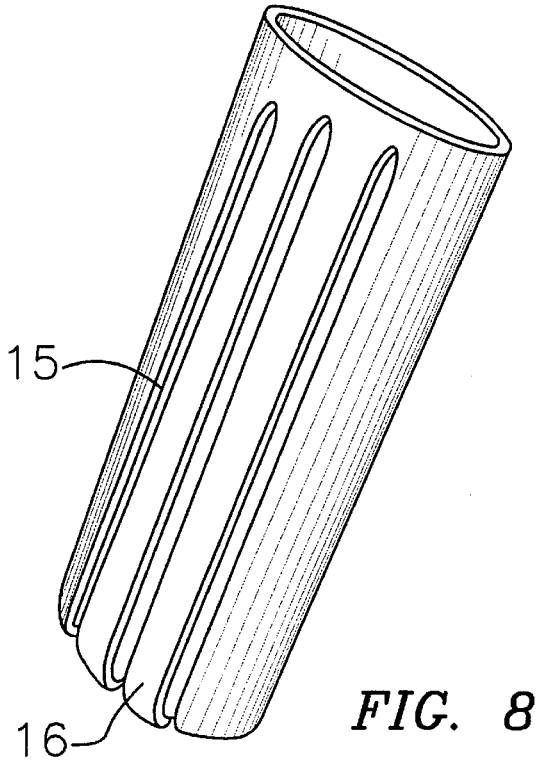
FIG. 8 illustrates another embodiment of the improved probe of the present invention.

Yet a further aspect of the invention is illustrated in the two embodiments shown in FIGS. 7 and 8, which describe improved vacuum probes.

In FIG. 7, hollow or tubular probe 12, having an open end 13 which communicates with a vacuum manifold (not shown) is provided with a plurality of apertures 14 evenly spaced over the length and tip of the probe to ensure complete dispension of the vacuum.

In FIG. 8 of the drawings, a series of parallel slots 15 extend longitudinally from the tip of a hollow or tubular probe 16 essentially its full length to distribute the vacuum.

Both probe embodiments are especially useful in the method of the invention as herein described.

What is claimed is:

1. A method for evacuating gas from a gas tight envelope containing solid or particulate material disposed therein, comprising providing an elongated vacuum probe having opposing longitudinal sides with one or more longitudinal grooves disposed on only one side of a surface thereof and extending from a vacuum source substantially the length of the probe, inserting through an orifice in said envelope said probe such that the surface of the probe having the longitudinal grooves is disposed within the envelope tangentially opposed to said contained solid material, applying a vacuum to said probe to withdraw gas along said grooves from said envelope opposite said material and collapsing said envelope around said contained solid material.

2. The method of claim 1 wherein said solid material is disposed in a horizontal plane and said probe enters the envelope from above, in a vertical direction thereto.

3. The method of claim 1 wherein said solid material is disposed in a tray.

4. The method of claim 1 wherein said probe enters the envelope from the side, in a horizontal direction.

* * * * *